United States Patent [19]

Church et al.

[11] 4,185,681

[45] Jan. 29, 1980

[54] CERAMIC KNOCK-OFF APPARATUS FOR REMOVING CERAMIC FROM INVESTMENT CASTING MOLDS

[75] Inventors: Thomas A. Church, Woodridge; Theodore W. Johnson, Wheaton, both of Ill.

[73] Assignee: Conveyersmith, Inc., LaGrange, Ill.

[21] Appl. No.: 918,107

[22] Filed: Jun. 22, 1978

[51] Int. Cl.[2] ..... B22D 29/00

[52] U.S. Cl. ..... 164/154; 15/89; 164/131; 164/404

[58] Field of Search ..... 164/131, 132, 154, 344, 164/401, 404; 15/89, 91, 104.07; 29/81 D, DIG. 46

[56] References Cited

U.S. PATENT DOCUMENTS

| | | | |
|---|---|---|---|
| 1,481,972 | 1/1924 | Aicher | 15/91 |
| 3,821,980 | 7/1974 | LaBahn et al. | 164/131 |
| 4,033,402 | 7/1977 | Eberle | 164/154 |

*Primary Examiner*—Robert D. Baldwin
*Assistant Examiner*—K. Y. Lin
*Attorney, Agent, or Firm*—Kirkland & Ellis

[57] ABSTRACT

Disclosed is a ceramic knock-off apparatus for automatically removing the ceramic coating from investment casting molds having a plurality of arms. Prior to operation, a ceramic covered mold is loaded into a receptacle on a turntable and rotated to a starting position thereby placing one of the arms of the ceramic covered mold directly under the head of an air hammer. The apparatus automatically removes the ceramic coating from each arm of an investment casting mold by lowering the air hammer until it engages the first arm of the mold, operating the hammer thereby vibrating that arm of the mold and causing the ceramic coating to break and fall off, raising the hammer, automatically rotating the turntable until the next arm of the mold is aligned under the air hammer, and lowering the hammer to engage the next arm. This cycle is repeated until the ceramic coating has been removed from every arm of the mold. As the ceramic coating is removed from the mold by the air hammer it falls into a scrap conveyor which carries it away for disposal. When the ceramic coating has been removed from every arm of the mold, the casting is removed from the receptacle on the turntable, and the apparatus is ready to repeat the operation on another investment casting mold. Control circuitry allows automatic programmable indexing of the turntable so that ceramic can be removed from an investment casting mold having any number of arms.

24 Claims, 9 Drawing Figures

13

20
48
48
29
44
44
40
40
46
40
40
47
47
18
18
60
60
58
22
15
60
63
59
60
26
51
100
34A
24
34
12
28
32
38
30
36
51
14
14
55
10

36
516
514
513
512
382
510
508
518
520
522
524
526
528
530
52
504
502
500
290
498
496
506
470
484
472
486
44
46
490
492
260
468
466
462
494
475
474
477
54
493
464
463
495
450
451
455
190
454
456
460
600
453
452
457
458

27
57
65
61
62
64
66
68
70
72
M
74
78
80
76
84
85
AUTO
MAN
45
82
86
88
90
92
93
94
95
96
97
98
99
101
102
103
104
106
108
110
112
114
122
124
166
168
170
121
126
128
130
162
33
132
134
136
158
118
119
138
140
142
154
144
146
148
150
100
106A
176
178
27
180
176
90A
186
188
190
192
193
37
197
90B
120
69
71
73
39
195
120A
35
85

| ANGLE OF ROTATION | OUTPUT ON CHANNEL |
|---|---|
| | |
| 0-1 | 1 2 |
| 2 | 1 |
| 44-46 | 7 |
| 59-61 | 6 |
| 71-73 | 5 |
| 89-91 | 4 7 |
| 119-121 | 3 6 |
| 134-136 | 7 |
| 143-145 | 5 |
| 179-181 | 4 6 7 |
| 215-217 | 5 |
| 224-226 | 7 |
| 239-241 | 3 6 |
| 269-271 | 4 7 |
| 287-289 | 5 |
| 299-301 | 6 |
| 314-316 | 7 |
| 357-359 | 1 2 |
| | |

CERAMIC KNOCK-OFF APPARATUS FOR REMOVING CERAMIC FROM INVESTMENT CASTING MOLDS

BACKGROUND OF THE INVENTION

1. Field of the Invention

The present invention relates to an apparatus for removing the ceramic coating from investment casting molds, and more particularly to an apparatus capable of automatically removing the ceramic coating from a plurality of arms of investment casting molds and carrying away for disposal the scrap ceramic material that is removed.

2. Description of the Prior Art

An apparatus to automatically remove the ceramic coating from investment casting molds is unknown in the prior art. Prior to the present invention, the ceramic coating was manually removed from investment casting molds by a person striking the coating with a hammer to break and knock the ceramic off the molded parts. The manual method of removing such coatings is considerably slower and less economical than the disclosed apparatus. Further, the disclosed apparatus also provides a means for efficiently carrying away the scrap ceramic material for disposal.

BRIEF DESCRIPTION OF THE INVENTION

The present invention comprises an improved apparatus for removing the ceramic coating from investment casting molds having a plurality of arms and particularly the usual configuration having three, four, five, six or eight arms. The ceramic knock-off apparatus includes a turntable having a receptacle for holding the ceramic covered mold while the turntable rotates the mold so that a ceramic coated arm of the mold is positioned directly beneath the air hammer prior to each hammering cycle. The present invention also comprises an air hammer means for striking the ceramic coating and causing it to break and fall off. The ceramic knock-off apparatus further comprises a scrap conveyor for carrying away the scrap ceramic material that is removed. In addition, the present invention also comprises electrical and pneumatic means for achieving the automatic operation of the ceramic knock-off apparatus.

Thus, it is a principal object of the present invention to provide an apparatus for automatically removing the ceramic coating from investment casting molds.

This and other objects, advantages, and features, shall hereinafter appear, and for the purposes of illustration, but not for limitation, exemplary embodiments of the present invention are illustrated in the accompanying drawings.

DETAILED DESCRIPTION OF THE PREFERRED EMBODIMENT

Figure 1:
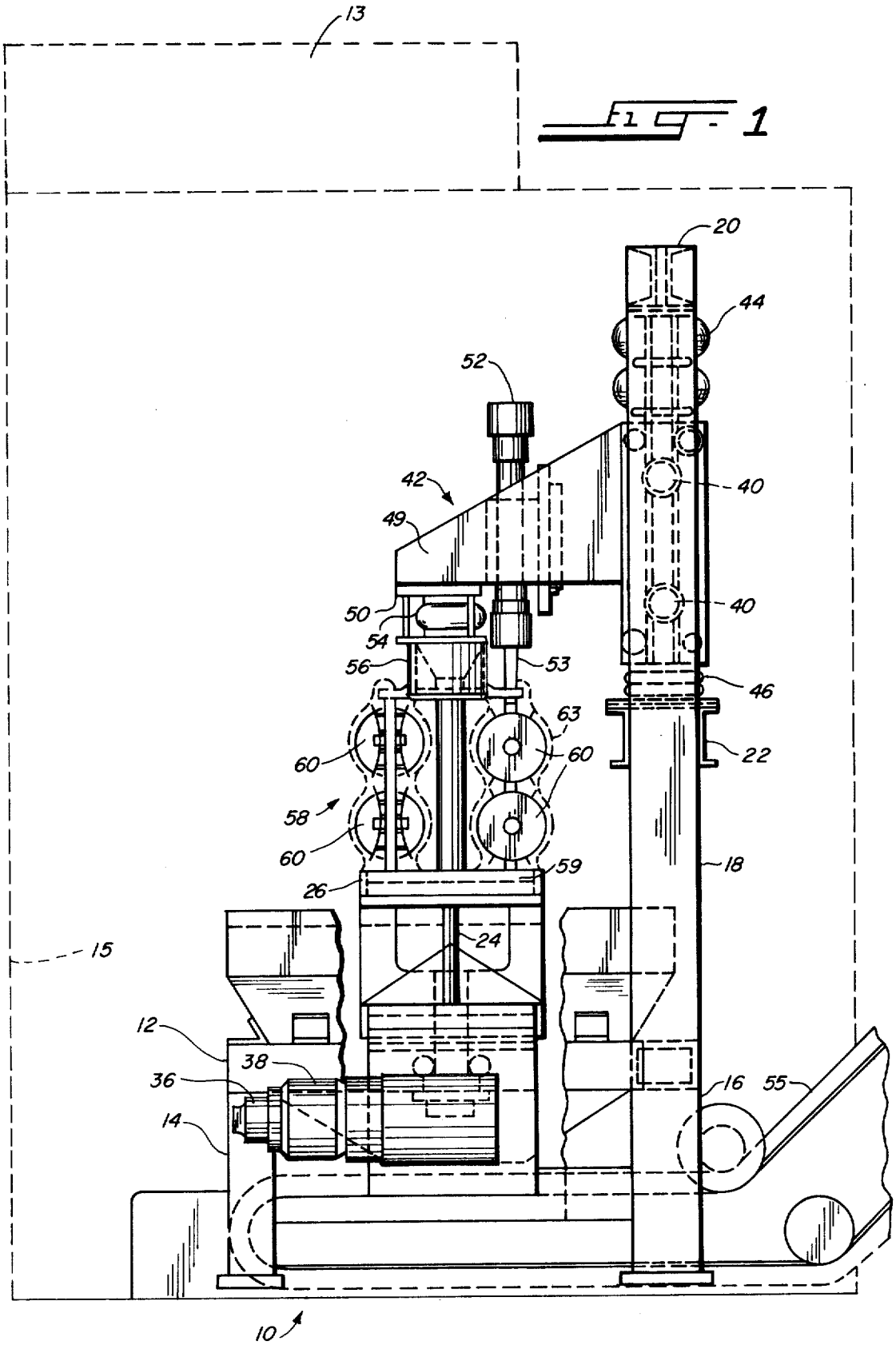
FIG. 1 is a side view of a preferred embodiment of the present invention.
Figure 2:
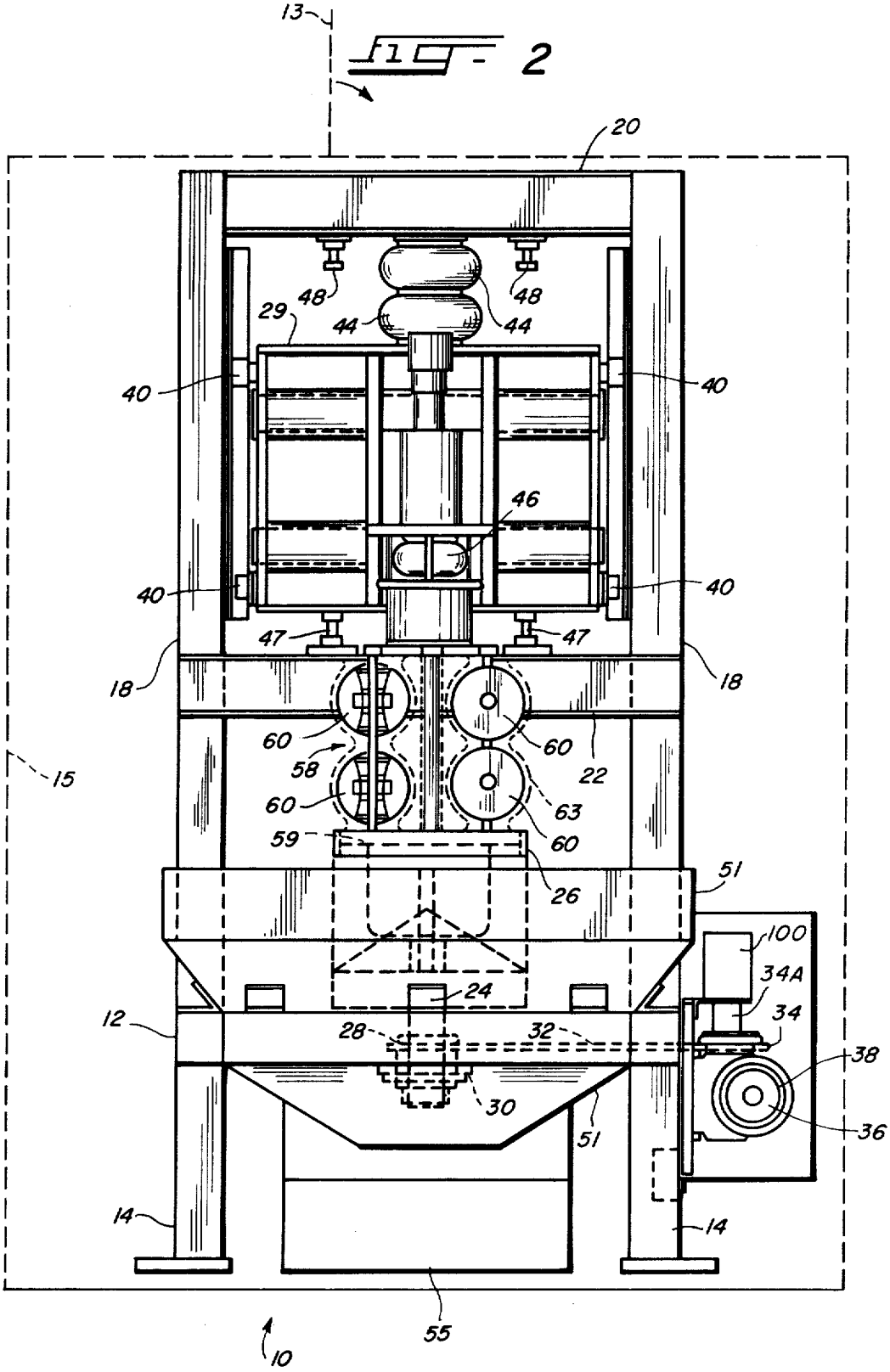
FIG. 2 is a front view of a preferred embodiment of the present invention.

With reference to FIGS. 1 and 2, ceramic knock-off apparatus 10 comprises a rectangular base frame 12 supported by front legs 14 and the lower portion 16 of vertically extending carriage channels 18. Mounted between channels 18 are lower cross support 22 and an upper cross support 20.

Rotatably mounted on frame 12 by a shaft 24 is a turntable 26. Shaft 24 extends through the bottom of frame 12 and a sprocket 28 is mounted on the lower end of shaft 24. Suitable bearing structure 30 is mounted to the lower side of frame 12 so that shaft 24 and attached turntable 26 can be freely rotated. A chain 32 is connected between sprocket 28 and a sprocket 34 mounted on the output shaft of a pneumatic motor 36. Also rigidly mounted on sprocket 34 to drive the rotation sensing means of PLS 100 is shaft 34A. Motor 36 is provided with a brake 38 which locks the output shaft of the motor whenever the motor is not operating.

Slideably mounted between carriage channels 18 on rollers 40 is a hammer carriage assembly 42. Expandable air bellows 44 and 46 are mounted to cross supports 20 and 22, respectively, and are connected to opposite sides of hammer carriage assembly 42. Alternative inflation and deflation of air bellows 44 and 46 causes the carriage 42 to move either up or down as will be more fully described below. The exact limits of travel of the carriage 42 can be adjusted by lower stops 47 and upper stops 48.

Hammer carriage assembly 42 comprises a rectangular base 29 upon which rollers 40 are mounted, trapezoidal shaped arms 49 extending outwardly from rectangular base 29 and a cross support member 50 joining the ends of arms 49. Mounted between arms 49 is a pneumatic hammer 52 having an operating hammer head 53 extending downwardly. Also mounted to cross support member 50 is an air bellows 54, and slideably mounted on the end of air bellows 54 is an upper casting receptacle 56.

An investment casting mold 58 is positioned within a receiving receptacle 59 mounted on turntable 26 and air bellows 54 is shown expanded until upper casting receptacle 56 engages the top of the casting mold 58 to clamp mold 58 between receptacle 56 and receptacle 59. Air bellows 44 is also shown to be expanded to lower carriage 42 until the head 53 of hammer 52 engages one of the multiple arms of the mold 58. Casting mold 58 may include any number of arms having molded parts 60 formed thereon. In the embodiment illustrated in FIGS. 1 and 2, four equiangular arms are illustrated and each arm has two molded parts 60 molded thereto. Initially, the casting mold has a ceramic covering 63 (indicated by the dotted lines surrounding the molded parts) surrounding the arms and the parts. The ceramic is initially formed around wax models of the parts and the wax is then melted from the interior of the ceramic when fired to form the ceramic mold into which molten metal is poured in accordance with known techniques of making investment casting molds. Ultimately, it is necessary to remove the ceramic so that the parts 60 can be removed from the arms and utilized. As the ceramic falls off the investment casting mold, it drops into a hopper 51 mounted to base 12 which channels the broken ceramic through the bottom of hopper 51 onto a conveyor 55 which transports the scrap ceramic away for disposal.

Figure 5:
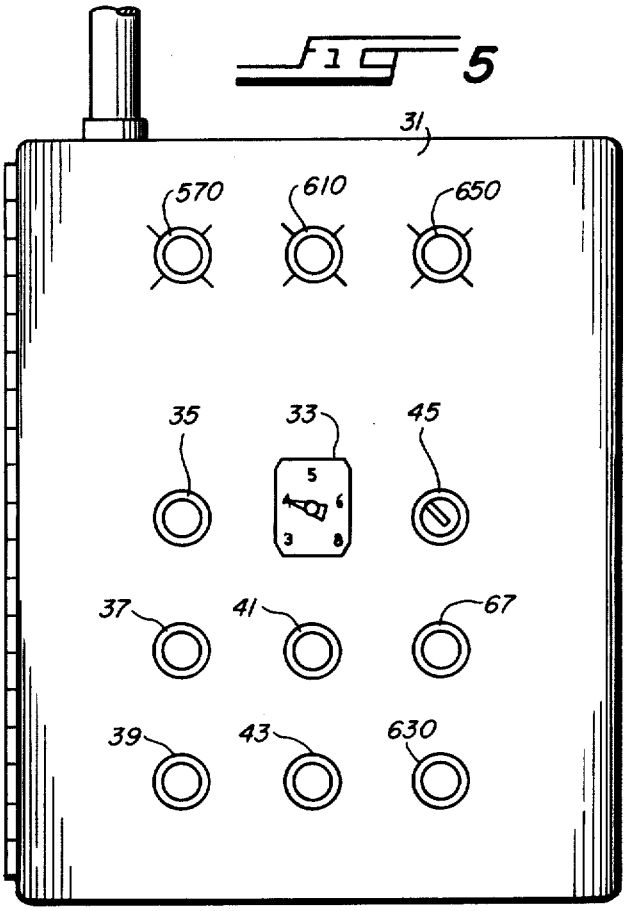
FIG. 5 is a front view of the operator station of the preferred embodiment of the present invention.
Figure 3:
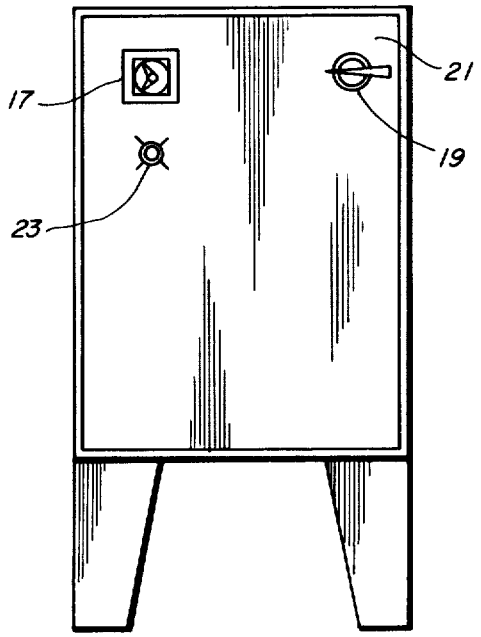
FIG. 3 is a view of the control panel of the preferred embodiment of the present invention.

The ceramic knock-off apparatus 10 is controlled from control panel 21 illustrated in FIG. 3 and operator station 31 illustrated in FIG. 5, which are located near the apparatus. A sound enclosure 15 (shown as dotted lines) may be placed around apparatus 10 to suppress the noise caused by the operation of the ceramic knock-off apparatus 10. Sound enclosure door (not shown) and top hatch 13 (shown in the "open" position in FIGS. 1 and 2) provide access to the ceramic knock-off apparatus 10.

Figure 6:
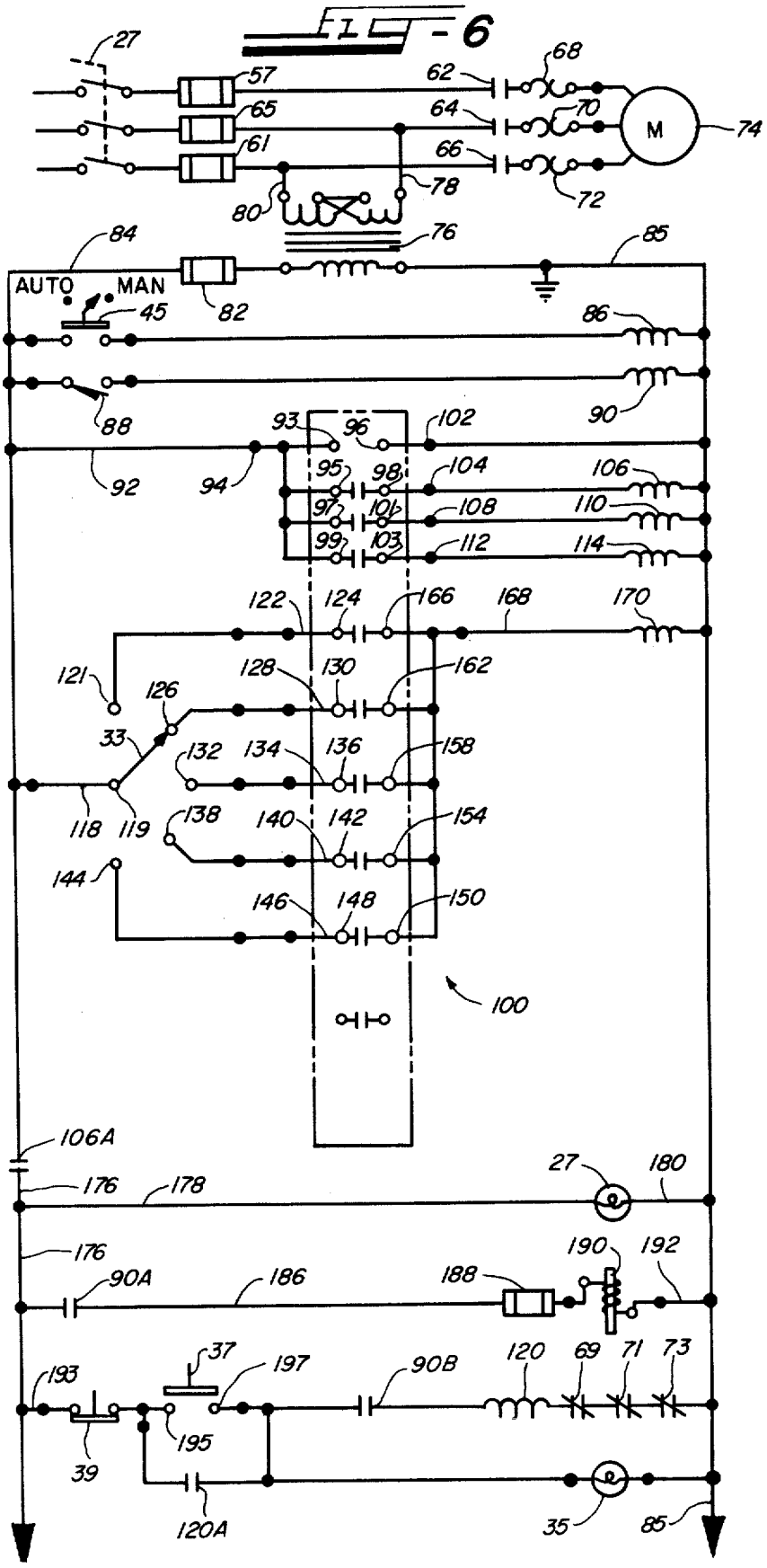
FIG. 6 is a schematic diagram of a portion of the control circuit of the preferred embodiment of the present invention.
Figure 7:
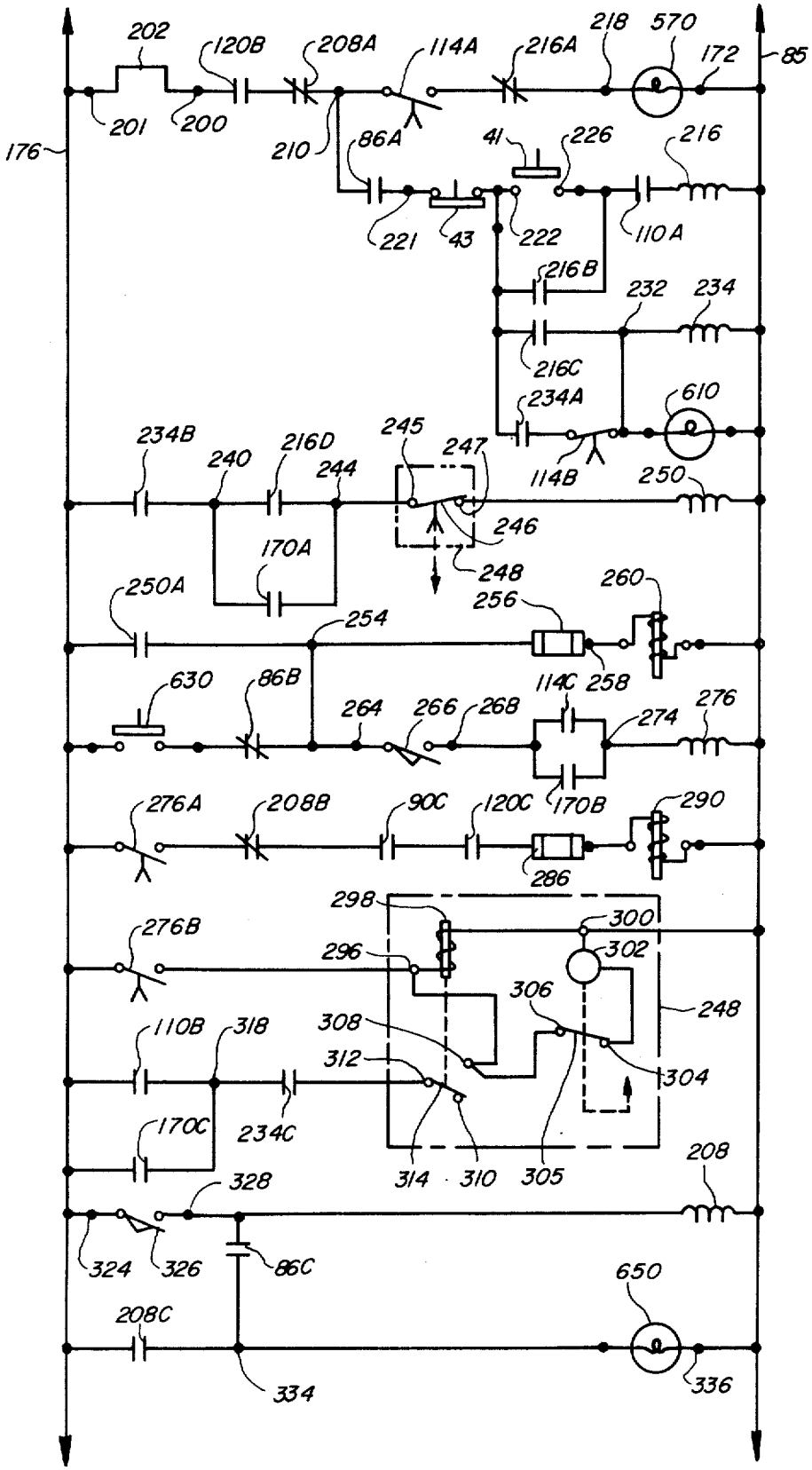
FIG. 7 is a schematic diagram of a portion of the control circuit of the preferred embodiment of the present invention.
Figures 8, 9:
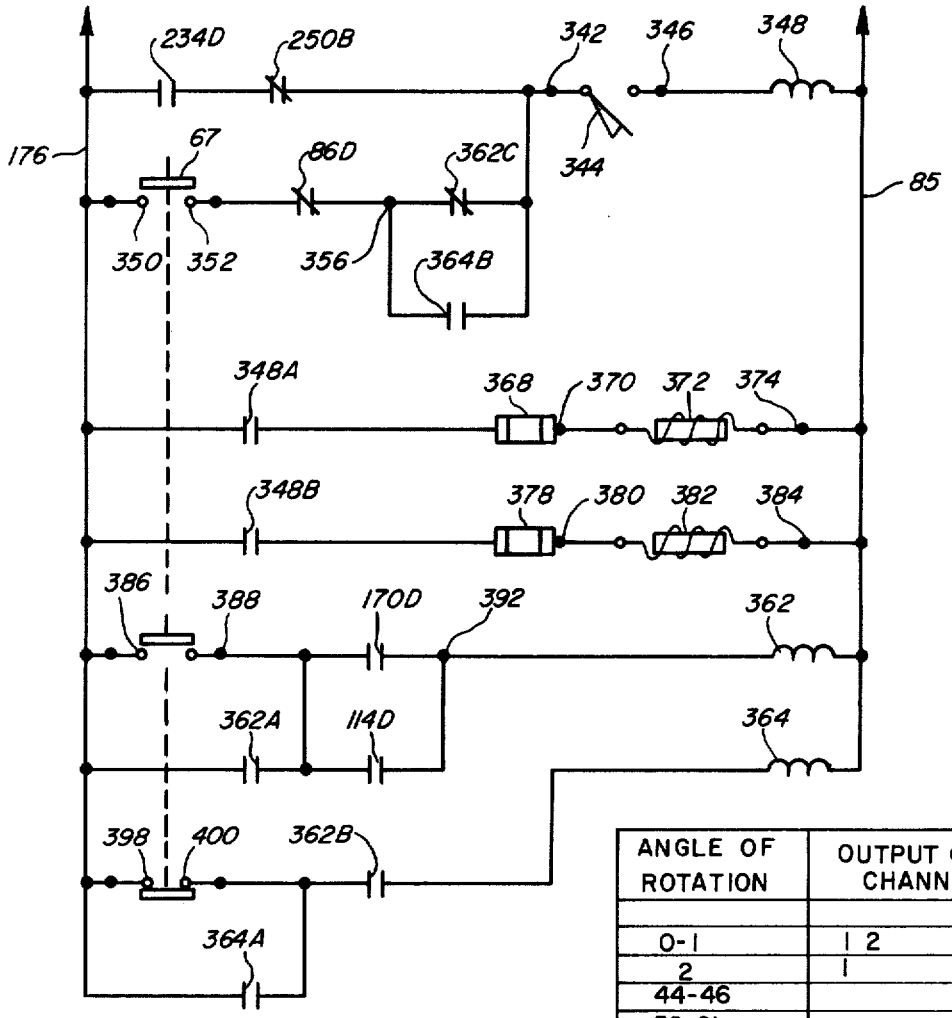
FIG. 8 is a schematic diagram of a portion of the control circuit of the preferred embodiment of the present invention.
FIG. 9 is a table showing the outputs of the programmable limit switch for various angles of rotation of the turntable of the preferred embodiment of the present invention.

With reference to the electrical control circuit illustrated in FIGS. 6, 7 and 8, and to FIG. 6 in particular, to apply 460 volt, 3 phase, 60 hertz supply power to the circuit, disconnect switch operator handle 19 (illustrated in FIG. 3) is rotated to the "ON" position, which closes disconnect switch contacts 27. Fuses 57, 61 and 65 are connected in series with disconnect switch contacts 27 and motor starter contacts 62, 64 and 66, which control scrap conveyor drive motor 74. Drive motor 74 is protected against overload by heaters 68, 70 and 72, which control overload relay contacts 69, 71 and 73, respectively. In the event an overload occurs on one or more of heaters 68, 70 or 72, the corresponding contacts 69, 71 or 73, respectively, open, thereby interrupting the circuit of motor starter coil 120 and causing contacts 62, 64 and 66 to open and interrupt the current flow to drive motor 74.

Transformer 76 is connected on the primary side to the input power through fuses 65 and 61 via leads 78 and 80. One side of the secondary of transformer 76 is connected to ground and the other side of the secondary of transformer 76 is connected through fuse 82 to line 84 which supplies power to various elements of the control circuit.

"OPERATING MODE" selector switch 45 and the coil of control relay 86 are connected in series between line 84 and ground. OPERATOR MODE selector switch 45 has two positions allowing either the "AUTO" (automatic) mode or the "MAN" (manual) mode to be selected. Thus, when the "AUTO" mode is selected, switch 45 is closed and the voltage on line 84 is applied to the coil of control relay 86 and the corresponding relay contacts 86A shown in FIG. 7 are closed. When the "MAN" mode is selected, no voltage is applied to the coil of control relay 86 and relay contacts 86A remain open. Also connected in series between line 84 and ground is sound enclosure door limit switch 88 and the coil of control relay 90. When the sound enclosure door (not shown) is closed, limit switch 88 is closed, thus applying the voltage on line 84 across the coil of "DOOR CLOSED" control relay 90. This closes corresponding relay contacts 90A (FIG. 6) of control relay 90, thus energizing solenoid 190 which causes the top hatch (not shown) to close. When the sound enclosure door (not shown) is opened, limit switch 88 opens, thereby de-energizing solenoid 190, which causes the top hatch 13 to open.

A programmable limit switch ("PLS") 100 is included in the circuit to control the indexing of the turntable 26. The left-hand "L1" terminal 93, "INHIBIT" terminal 95, Channel 1 terminal 97, and Channel 2 terminal 99 of PLS 100 are all connected to terminal 94, which is connected to line 84 via line 92. Right-hand "L2" terminal 96 of PLS 100 is connected to ground via terminal 102. The coil of control relay 106 is connected between right-hand "INHIBIT" terminal 98 of PLS 100 and ground. The coil of control relay 110 is connected between right-hand Channel 1 terminal 101 of PLS 100 and ground. The coil of control relay 114 is connected between right-hand Channel 2 terminal 103 of PLS 100 and ground. When PLS 100 is functioning properly, the voltage on line 84 is applied to the coil of control relay 106, thus closing corresponding contacts 106A of control relay 106 and applying power to the remaining portions of the electrical control circuit via line 176. Similarly, relay contacts 110A (shown in FIG. 7) of control relay 110 are closed when there is an output on Channel 1 and open when there is not an output on Channel 1. Likewise, relay contacts 114A (shown in FIG. 7) of time delay control relay 114 close after a short delay when there is an output on Channel 2 of PLS 100. Each channel of PLS 100 conducts between its left-hand and right-hand terminals when an output is produced on that channel by PLS 100. The outputs occur on the respective channels as indicated by the table shown in FIG. 9, where the outputs are listed as a function of the angle of rotation of turntable 26. PLS 100 utilizes rotation sensing means (not shown) to sense the amount of angular rotation of turntable 26 and to thereby provide an output signal corresponding to the amount of angular rotation of turntable 26. With reference to FIG. 2, the rotation sensing means of PLS 100 is interconnected with turntable 26 via shaft 34A, sprocket 34, chain 32, sprocket 28 and shaft 24. Shaft 34A, which is thereby rotated whenever turntable 26 is rotated, is connected to the rotation sensing means of PLS 100. The rotation sensing means thereby senses the angular rotation of turntable 26 by sensing the angular rotation of shaft 34A. As discussed more fully below, the angles of rotation of turntable 26 for which PLS 100 produces an output on one of its channels correspond to the angular positions of arms of investment casting mold 58 on which ceramic knock-off apparatus 10 operates.

Input terminal 119 of "SELECT NUMBER OF ARMS" selector switch 33 on operation station 31 (See FIG. 5) is connected to line 84 via lead 118. Contact 121 of selector switch 33 is connected via lead 122 to left-hand terminal 124 of Channel 3 of PLS 100; contact 126 of selector switch 33 is connected via lead 128 to left-hand terminal 130 of Channel 4 of PLS 100; contact 132 of selector switch 33 is connected via lead 134 to left-hand terminal 136 of Channel 5 of PLS 100; contact 138 of selector switch 33 is connected via lead 140 to left-hand terminal 142 of Channel 6 of PLS 100; and contact 144 of selector switch 33 is connected via lead 146 to the left-hand terminal 148 of Channel 7 of PLS 100. PLS 100, in cooperation with the associated circuitry, provides a turntable switching means which receives the output of "SELECT NUMBER OF ARMS" selector switch 33 and provides output signals that control the rotation of turntable 26 to sequentially align each arm of the investment casting mold in position for being operated on by pneumatic hammer 52, as hereinafter described in greater detail. The output signals produced by PLS 100, in cooperation with other circuitry including "LOWER HAMMER AND CLAMP" solenoid 260 which controls direction control valve 468 in the pneumatic system, is also utilized to control the positioning of hammer carriage assembly 42, as hereinafter described. The position of pneumatic hammer 52 is thereby controlled since pneumatic hammer 52 is mounted on hammer carriage assembly 42. Thus, a hammer position switching means is provided. The right-hand output terminals 166, 162, 158, 154 and 150 of Channels 3, 4, 5, 6 and 7 are all connected to lead 168. The coil of control relay 170 is connected between lead 168 and ground. Thus, when there is an output on the channel of PLS 100 corresponding to the left-hand input to which selector switch 33 is set, the voltage on line 84 is applied across the coil of control relay 170 causing associated relay contacts 170A, 170B, and 170C (shown in FIG. 7), and relay contacts 170D (shown in FIG. 8), to close.

Relay contacts 106A of control relay 106 are connected in series between line 84 and lead 176. The "CONTROL POWER ON" pilot light 23 is connected between lead 176 and ground. Thus, when voltage is applied to lead 176 via line 84 and relay contacts 106A, "CONTROL POWER ON" pilot light 23 lights, thereby indicating that power is being applied to the control circuit and that PLS 100 is operating. Relay contacts 90A of control relay 90, fuse 188 and solenoid 190 are connected in series between lead 176 and ground and operate to close top hatch 13, as discussed above.

Lead 176 is connected by lead 193 to one side of "SCRAP CONVEYOR STOP" pushbutton switch 39. "SCRAP CONVEYOR START" pushbutton switch 37 bridges contacts 195 and 197. Relay contacts 90B of "DOOR CLOSED" control relay 90, the coil of motor starter coil 120 and normally-closed motor overload relay contacts 69, 71 and 73 are connected in series between contact 197 and ground. Auxiliary motor starter contacts 120A of motor starter 120 are connected in parallel with "SCRAP CONVEYOR START" pushbutton switch 37. "SCRAP CONVEYOR RUNNING" pilot light 35 is connected in series between contact 197 and ground. "SCRAP CONVEYOR STOP" pushbutton switch 39 is normally closed. Therefore, "SCRAP CONVEYOR RUNNING" pilot light 35 lights when "SCRAP CONVEYOR START" pushbutton switch 37 is pushed to the "ON" position, thereby applying a current to contact 197. Assuming that the sound enclosure door (not shown) is closed, relay contacts 90B of control relay 90 are closed and the voltage on contact 197 is applied to the coil of control relay 120, thereby closing auxiliary motor starter contacts 120A of motor starter 120. Auxiliary motor starter contacts 120A provide a parallel path between contacts 195 and 197, thus causing the coil of control relay 120 to continue to have voltage applied across it after "SCRAP CONVEYOR START" pushbutton switch 37 is released. "SCRAP CONVEYOR RUNNING" pilot light 35, therefore, also continues to be lit after pushbutton switch 37 is released.

Leads 176 and 85, shown in FIG. 7, are connected to lead 176 and 85, shown in FIG. 6. With reference to FIG. 7, terminals 201 and 200 are connected via jumper lead 202. Auxiliary contacts 120B of "SCRAP CONVEYOR" motor starter 120 are connected in series with the normally closed relay contacts 208A of "NO HAMMER OVER-EXTENSION" control relay 208 (see bottom of FIG. 7). Relay contacts 114A of time delay control relay 114 (see FIG. 6) are connected in series with normally closed relay contacts 216A of "NOT AUTO CYCLE START" control relay 216. "CYCLE READY" pilot light 570 is connected between contacts 216A and ground. Thus, when scrap conveyor 55 is running, hammer 52 is not overextended, turntable 26 is rotated to the zero degree starting position, and the cycle has not automatically started, the "CYCLE READY" pilot light 570 has voltage applied across it causing it to light to indicate that condition, Relay contacts 86A of "AUTO MODE" control relay 86 are connected in series with "AUTO CYCLE STOP" pushbuttom switch 43 between terminal 210 and contact 222 of "AUTO CYCLE START" pushbutton switch 41. Relay contacts 86A of control relay 86 are closed when "OPERATING MODE" selector switch 45 is in the "AUTO" position. Relay contacts 216B of control relay 216 and "AUTO CYCLE START" pushbutton switch 41 are connected in parallel between contacts 222 and 226 of switch 41. Relay contacts 216B close when there is a voltage across the coil of control relay 216, thus causing the voltage to continue being applied after "AUTO CYCLE START" pushbutton switch 41 is released, providing that relay contacts 110A, 120B and 208A are closed. Relay contacts 110A are closed when PLS 100 has an output on Channel 1, which occurs when turntable 26 is rotated to approximately zero degrees. Relay contacts 110A of control relay 110 and the coil of control relay 216 are connected in series between contact 226 and ground. One side of relay contacts 216C of control relay 216 are connected to contact 222, and the coil of "AUTO CYCLE CONTINUE" control relay 234 is connected from terminal 232 to ground. Thus, when "AUTO CYCLE START" pushbutton switch 41 is pushed, voltage is applied to the coil of control relay 234 via relay contacts 216C. Relay contacts 234A of control relay 234 are connected in series with normally closed contacts 114B of time delay control relay 114. After initially being energized via relay contacts 216C, relay contacts 234A are closed, thus providing an alternative path via relay contacts 114B to the coil of "AUTO CYCLE CONTINUE" control relay 234 and pilot light 610. Relay contacts 114B of time delay control relay 114 open after a short delay when there is an output on Channel 2 of PLS 100, which occurs when turntable 26 has rotated completely around and returned to approximately zero degrees. "AUTO CYCLE ON" pilot light 610 lights when voltage is being applied to control relay 216. "AUTO CYCLE ON" pilot light 610 remains on after voltage is removed from the coil of control relay 216, that is, after the cycle begins and control relay contacts 110A open, until relay contacts 114B open. Relay contacts 114B open following a time delay after turntable 26 rotates to the zero degree or "home" position at the end of an operating cycle of ceramic knock-off apparatus 10.

Relay contacts 234B of "AUTO CYCLE ON" control relay 234 are connected between lead 176 and terminal 240. Relay contacts 216D of "AUTO CYCLE START" control relay 216 are connected in parallel with relay contacts 170A of "ARM" control relay 170 between terminals 240 and 244. Thus, the voltage on lead 176 is applied to terminal 240 when relay contacts 234B are closed, which occurs for the duration of the automatic cycle. Contacts 245 and 247 of timer relay 248 are connected in series with the coil of control relay 250 between terminals 244 and ground. Timer switch 246 connects contacts 245 and 247 until timer 248 is "timed out", as discussed below. The voltage at terminal 240 is applied to terminal 244 at the start of the automatic cycle or whenever turntable 26 is rotated to align with an arm of the mold. This occurs because the coil of control relay 170 has voltage applied to it whenever the amount of angular rotation of turntable 26 is equal to the angle at which an equiangular arm is located when the setting of selector switch 33 corresponds to the number of equiangular arms of the mold. Thus, voltage is applied to control relay 170 whenever the angular rotation of turntable 26 equals the angle of one of the equiangular arms on a casting corresponding to the setting of selector switch 33, thereby reaching an "assumed arm position." Thus, a voltage is applied across the coil of "HAMMER CYCLE" control relay 250 whenever during an automatic cycle turntable 26 is rotated to the starting position or one of the angular arm positions and until time delay control relay 248 (described below) is timed out. A hammer cycle begins when turntable 26 is rotated to the starting position or one of the angular arm positions and ends when time delay relay 248 is timed out. During each hammer cycle, therefore, relay contacts 250A are closed, and relay contacts 250B (see FIG. 8) are open.

Relay contacts 250A of "HAMMER CYCLE" control relay 250 are connected between lead 176 and terminal 254. Fuse 256 and "LOWER HAMMER AND CLAMP" solenoid 260 are connected in series between terminal 254 and ground. Consequently, solenoid 260 is energized causing hammer carriage assembly 42 to lower hammer 52 against an arm of investment casting mold 58 during each hammer cycle. "MANUAL HAMMER" pushbutton switch 630 is connected in series with normally closed relay contacts 86B of control relay 86. If "OPERATING MODE" selector switch 45 is switched to "MAN", relay contacts 86B will be closed and voltage can be applied to terminal 264 and to solenoid 260 by depressing "MANUAL HAMMER" pushbutton switch 630, thus causing hammer carriage assembly 42 to lower. "HAMMER LOWERED" limit switch 266 is connected between terminals 264 and 268 and is closed when hammer 52 is lowered into position for a hammer cycle. Relay contacts 114C of control relay 114 and relay contacts 170B of control relay 170 are connected in parallel between terminals 268 and 274. The coil of time delay control relay 276 is connected between terminal 274 and ground. Consequently, during an automatic cycle, voltage is applied to the coil of time delay control relay 276 via relay contacts 250A and limit switch 266 when hammer carriage assembly 42 is lowered and turntable 26 is rotated to one of the mold arm positions or the stopping position of approximately zero degrees. During a manual cycle, voltage is applied to the coil of time delay control relay 276 causing hammer 52 to operate (as discussed below) whenever the "MANUAL HAMMER" pushbutton switch 630 is depressed, hammer carriage assembly 42 is lowered to close limit switch 266, and turntable 26 is rotated to one of the assumed arm positions or the stopping position of approximately zero degrees.

Relay contacts 276A, which close during the hammer cycle after voltage is applied to the coil of time delay control relay 276, normally closed "NO HAMMER OVER EXTENSION" relay contacts 208B, "DOOR CLOSED" relay contacts 90C, "SCRAP CONVEYOR RUNNING" auxiliary contacts 120C, fuse 286 and "HAMMER" solenoid 290 are connected in series between terminal 201 and ground. "HAMMER" solenoid 290 controls the on-off operation of hammer 52. The foregoing circuitry thereby provides a hammer switching means for providing the necessary output signals to control "HAMMER" solenoid 290 which controls pneumatic hammer 52 by means of directional control valve 498 in the pneumatic system, as hereinafter described in greater detail. The relay contacts 276B of time delay control relay 276 are connected from lead 176 to terminal 296 of timer 248. Timer 248 controls the duration of each hammer cycle, which is variable by "HAMMERING INTERVAL" control 17 mounted on panel 21. Timer solenoid 298 is connected from terminal 296 to terminal 300, and terminal 300 is connected to ground. Motor 302 is connected back to terminal 296 via terminals 304, 306 and 308. Timer switch 305 connects terminals 304 and 306 until motor 302 is "timed out". When motor 302 is "timed out," timer switch 305 and timer switch 246 are opened. When solenoid 298 is energized via time delay control relay contacts 276B, timer switch 314 is switched from terminal 310 to terminal 308. Then voltage is applied to motor 302 via terminals 308 and 312 to begin the timing operation if relay contacts 110B or 170C and relay contacts 234C are closed. Relay contacts 110B are closed when turntable 26 is rotated to approximately zero degrees, relay contacts 170C are closed when turntable 26 is rotated to one of the assumed arm positions, and relay contacts 234C are closed when the coil of "AUTO CYCLE CONTINUE" control relay 234 is energized.

Terminal 324 is connected to lead 176 and "HAMMER OVER EXTENDED" limit switch 326 is connected between terminals 324 and 328. The coil of control relay 208 is connected from terminal 328 to ground. "AUTO MODE" relay contacts 86C are connected between terminals 328 and 334. Relay contacts 208C of control relay 208 are connected between terminals 324 and 334. "HAMMER OVER EXTENDED" flashing pilot light 650 is connected between terminals 334 and 336, and terminal 336 is connected to ground. Thus, if hammer 52 for any reason is over extended, limit switch 326 will close, thus applying a voltage to the coil of control relay 208. If "OPERATING MODE" switch 45 is in the "AUTO" position, relay contacts 86C will be closed and a voltage will also be applied to terminal 334, thus lighting pilot light 650. If "OPERATING MODE" switch 45 is in the "MAN" position, relay contacts 86C will be open. However, relay contacts 208C provide an alternative path by which voltage is applied to terminal 334, thus lighting pilot light 650 whenever limit switch 326 is closed. After limit switch 326 is opened again by retracting hammer 52, voltage will continue to be applied to the coil of relay 208 via relay contacts 86C if the "AUTO" mode is selected on switch 45, thus causing pilot light 650 to continue flashing until switch 45 is switched off "AUTO" to "MAN". This provides a warning to the operator that the hammer has become over-extended, since the hammer could be damaged if it remained over-extended without contacting anything during automatic hammering operation. The warning light indicate, for example, that "SE- LECT NUMBER OF ARMS" selector switch 33 is set incorrectly and that, consequently, turntable 26 is not stopping with an arm of the investment casting mold positioned below hammer 52.

Referring to FIG. 8, relay contacts 234D of "AUTO CYCLE CONTINUE" control relay 234 (shown in FIG. 7) are connected in series with relay contacts 250B of "NOT HAMMERING CYCLE" control relay 250 between lead 176 and terminal 342. Leads 176 and 85 in FIG. 8 are connected to leads 176 and 85 in FIG. 7. The coil of control relay 348 is connected in series with "HAMMER RAISED" limit switch 344 between terminal 342 and ground. Thus, voltage is applied to the coil of control relay 348 via relay contacts 234D and 250B when the apparatus is in an auto cycle, the apparatus is not in a hammer cycle, and hammer 52 is raised. Relay contacts 348A of control relay 348, fuse 368 and "RELEASE BRAKE" solenoid 372 are connected in series between lead 176 and ground. Thus, when voltage is applied to the coil of control relay 348, contacts 348A are closed and solenoid 372 is energized thereby causing brake 38 (shown in FIG. 1) on motor 36 to release. Similarly, relay contacts 348B of control relay 348, fuse 378 and "ROTATE TURNTABLE" solenoid 382 are connected between lead 176 and ground. When voltage is applied to the coil of control relay 348, contacts 348B are closed and solenoid 382 is energized thereby causing turntable 26 to rotate. Thus, a homing means is provided when ceramic knock-off apparatus 10 is operating in the automatic ("AUTO") mode whereby turntable 26 will sequentially rotate to each assumed arm position and finally stop at the home position of zero degrees for each automatic operating cycle of ceramic knock-off apparatus 10.

Contact 386 of "MANUAL ROTATE" pushbutton switch 67 is connected to lead 176. Contact 388 of pushbutton switch 67 is connected through relay contacts 170D of "ARM" control relay 170 to terminal 392. The coil of relay 362 is connected from terminal 392 to ground. Relay contacts 362A of control relay 362 are connected between lead 176 and terminal 388. Relay contacts 114D of control relay 114 are connected between terminals 388 and 392, in parallel with relay contacts 170D. Thus, when "MANUAL ROTATE" pushbutton switch 67 is pushed to "ON", and when turntable 26 is rotated to either approximately zero degrees or to an assumed arm position so that either relay contacts 170D or 114D, respectively, are closed, voltage is applied to the coil of control relay 362. Relay contacts 362A of control relay 362 will then close so that voltage will continue to be applied to the coil of relay 362 after switch 67 is released provided turntable 26 is rotated either to approximately zero degrees or to an assumed arm position.

Pushbutton switch 67 is normally closed between contacts 398 and 400. Terminal 398 is connected to lead 176. Relay contacts 364A of control relay 364 are connected between contacts 398 and 400. Relay contacts 362B of control relay 362 are connected in series with the coil of control relay 364 between contact 400 and ground. Thus, when voltage is applied to the coil of control relay 362 thereby closing relay contacts 362B, voltage is applied to the coil of control relay 364 thereby closing relay contacts 364A of control relay 364. Therefore, voltage will continue being applied to the coil of control relay 364 while voltage is applied to the coil of control relay 362.

"MANUAL ROTATE" pushbutton switch 67 is normally open across contacts 350 and 352. Normally closed contacts 86D of "AUTO MODE" control relay 86 are connected between contact 352 and terminal 356. Normally closed relay contacts 362C of control relay 362 are connected between terminals 356 and 342. Therefore, when "OPERATING MODE" switch 45 is set to "MAN", normally closed relay contacts 86D will be closed. If turntable 26 is not positioned at either zero degrees or one of the assumed arm positions, voltage is not applied to the coil of control relay 362 and consequently normally closed relay contacts 362C will be closed providing a path between terminals 356 and 342, causing turntable 26 to rotate when pushbutton 67 is pressed. If turntable 26 is rotated to either zero or one of the assumed arm positions so that voltage is being applied to the coil of control relay 362, relay contacts 364B will provide a path from terminal 356 to terminal 342. Thus, in the "MAN" mode, voltage will be applied to the coil of control relay 348 when "MANUAL ROTATE" pushbutton switch 67 is depressed and hammer 52 is raised, thereby energizing solenoid 382 and causing turntable 26 to be rotated, until an assumed arm position or the starting position is reached. Pushbutton switch 67 is then released by the operator causing voltage to be applied to the coil of control relay 364. After pushbutton 67 has been released, rotation of turntable 26 is accomplished by depressing pushbutton switch 67 again. Since turntable 26 is initially at an assumed arm position, relay contacts 362C are open. Relay contacts 364B are initially closed, however, since voltage is then being applied to control relay 364 via relay contacts 364A and 362B. After rotating past the assumed arm position, voltage is no longer applied to control relay 362 and, consequently, relay contacts 362C are again closed and relay contacts 364B are open and turntable 26 continues to rotate while pushbutton switch 67 is depressed until the next assumed arm position is reached.

FIG. 5 shows a front view of operator station 31 of the ceramic knock-off apparatus 10. Located at the top are "CYCLE READY" green pilot light 570, "AUTO CYCLE ON" amber pilot light 610 and "HAMMER OVER EXTENDED" red flashing pilot light 650. "SELECT NUMBER OF ARMS" selector switch 33 is located approximately in the center of operator station 31. "SCRAP CONVEYOR RUNNING" amber pilot light 35 is located to the left of selector switch 33. Below that is located "SCRAP CONVEYOR START" green pushbutton 37 and below that is located "SCRAP CONVEYOR STOP" red pushbutton 39. "AUTO CYCLE START" green pushbutton 41 is located below selector switch 33. "AUTO CYCLE STOP" red pushbutton 43 is located on the bottom center. "OPERATING MODE" selector switch 45 is located to the right of selector switch 33. Below that is located "MANUAL ROTATE" black pushbutton 67 and in the bottom right hand corner is located "MANUAL HAMMER" black pushbutton 630.

Figure 4:
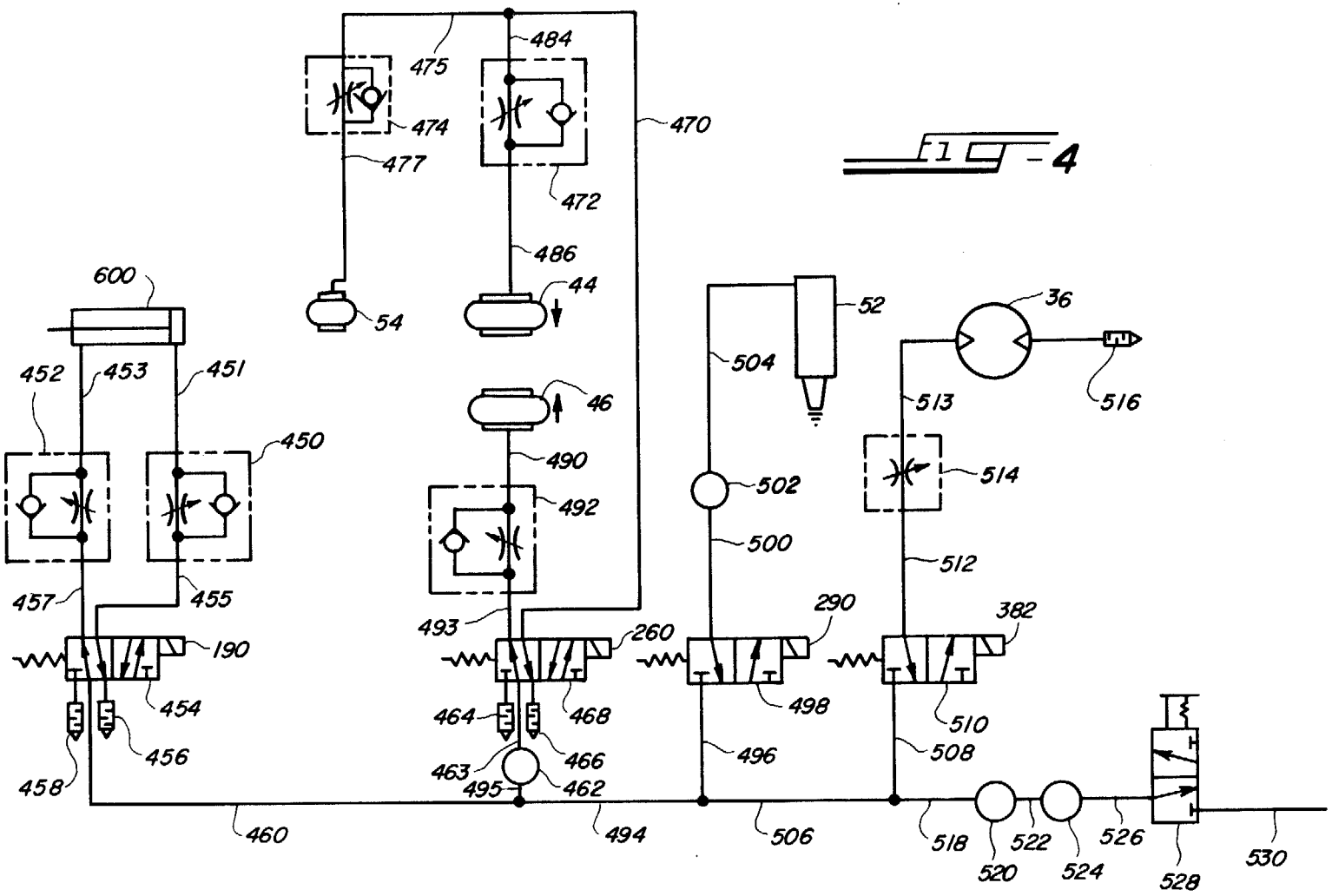
FIG. 4 is a pneumatic schematic of the preferred embodiment of the present invention.

The pneumatic system of the ceramic knock-off apparatus is illustrated in FIG. 4. With reference to FIG. 4, air is supplied to safety-lock valve 528 via pressure line 530. Air from safety-lock valve 528 flows through filter 524 and lubricator 520 to line 518 which supplies air to the rest of the pneumatic system. Directional control valve 510 receives air via line 508 and is controlled by "ROTATE TURNTABLE" solenoid 382. Directional control valve 510 controls the air flow to pneumatic motor 36, which drives turntable 26. As discussed above with reference to FIG. 8, turntable 26 rotates when solenoid 382 is energized and air is allowed to flow from directional control valve 510 through needle valve 514 to air motor 36 and exhaust manifold 516. Needle valve 514 serves to control the air flow to air motor 36 and to thereby control the speed of rotation of turntable 26.

Lines 506 and 496 connect the air supply to directional control valve 498 which is controlled by "HAMMER" solenoid 290. When solenoid 290 is energized, directional control valve 498 supplies air to hammer 52 via line 500, lubricator 502 and line 504 to operate hammer 52.

Lines 494 and 495 supply air via regulator 462 to the hammer carriage assembly 42 and air bellows 54. Line 463 supplies air to direction control valve 468, which is controlled by "LOWER HAMMER AND CLAMP" solenoid 260. When solenoid 260 is energized, air flows from directional control valve 468 via lines 470 and 484 and flow control valve 472 causing air bellows 44 to inflate. At the same time, air flows out of air bellows 46, causing it to deflate, and into direction control valve 468 via line 490, flow control valve 492 and line 493. The inflating of air bellows 44 and deflating of air bellows 46 cause hammer carriage assembly 42 to lower. Exhaust mufflers 464 and 466 are connected to direction control valve 468 and allow air to be expelled quietly when hammer carriage assembly 42 is raised or lowered and air bellows 44 or 46, respectively, is deflated. When solenoid 260 is energized causing hammer carriage assembly 42 to lower, air is also supplied by directional control valve 468 to air bellows 54 via line 475, flow control valve 474, and line 477. This causes air bellows 54 to inflate and thereby exert force via upper casting receptacle 56 against the investment casting mold 58, thus clamping it firmly in receptacle 59 (not shown in FIG. 4, see FIG. 1) on turntable 26. Air bellows 54 and 44 deflate to unclamp the casting mold when solenoid 260 is de-energized.

Line 460 connects the air supply to directional control valve 454. When "CLOSE SOUND ENCLOSURE TOP HATCH" solenoid 190 is energized, air flows through directional control valve 454, to sound enclosure top hatch actuator 600 via line 455, flow control valve 450 and line 451. At the same time air is returned from top hatch actuator 600 via line 453, flow control valve 452 and line 457 to directional control valve 454 and is expelled through exhaust muffler 458. Thus, energizing solenoid 190 causes top hatch actuator 600 to close the top hatch 13 (see FIGS. 1 and 2). When solenoid 190 is de-energized, the direction of air flow through direction control valve 454 is reversed, air is expelled through exhaust muffler 456 and the top hatch 13 is opened.

Description of an Operating Cycle of the Ceramic Knock-Off Apparatus

To start the control power, disconnect switch operator handle 19 is rotated to the "ON" position. White "CONTROL POWER ON" pilot light 27 will light if there is power supplied to the panel and if PLS 100 is operating.

The ceramic covered mold 58 is loaded into receptacle 59 on turntable 26 by the operator. Prior to loading he must knock the ceramic from the bottom of the mold 58 in order that the mold will sit squarely on receptacle 59. Receptacle 59 is designed such that one of the arms is directly under air hammer 52 when turntable 26 is rotated to the starting position (0° reference).

The operator then closes the sound enclosure door (not shown) which causes the top hatch 13 on top of enclosure 15 to close. He then depresses green "SCRAP CONVEYOR START" pushbutton 37 to run scrap removal conveyor 55. Conveyor 55 will not run unless the sound enclosure door is closed. If conveyor 55 starts, amber "SCRAP CONVEYOR RUNNING" light 35 is lit, and if turntable 26 is rotated to the starting position, green "CYCLE READY" pilot light 57 is lit.

The operator then switches "SELECT NUMBER OF ARMS" selector switch 33 to the number of arms on the mold that has been loaded into ceramic knock-off apparatus 10, and switches "OPERATING MODE" selector switch 45 to "AUTO".

Green "AUTO CYCLE START" pushbutton switch 41 may now be depressed to start the cycle. Green "CYCLE READY" pilot light 57 goes out and amber "AUTO CYCLE ON" pilot light 61 is lit.

Hammer carriage assembly 42 lowers pneumatic hammer 52 until hammer head 53 of hammer 52 makes contact with the top of an arm of mold 58. After a short time delay, hammer 52 is activated, vibrating the ceramic off of mold 58. The length of time that the hammer operates is determined by the setting of "HAMMERING INVERVAL" timer 17, which is mounted on control panel 21 and which controls timer relay 248.

Following the hammer cycle, hammer 52 stops and hammer carriage assembly 42 rises. Turntable 26 then rotates to the next assumed arm position. The angle of rotation for a three-arm mold is 120°; for a four-arm is mold 90°; for a five-arm mold is 72°; for a six-arm mold is 60°; and for an eight-arm mold is 45°. At the next arm position, hammer 52 lowers and the hammering cycle is repeated. The homing means provided by the circuitry of the present invention causes this sequence to continue until each arm of the mold has been hammered and turntable 26 has rotated one complete revolution and is back at the starting or home position. At this time amber "AUTO CYCLE ON" pilot light 61 goes out, and green "CYCLE READY" pilot light 57 is again lit. Mold 58 may then be removed from ceramic knock-off apparatus 10. Depressing red "SCRAP CONVEYOR STOP" pushbutton 39 or opening the sound enclosure door (not shown) will stop scrap removal conveyor 55.

If, at any time during the cycle, hammer carriage assembly 42 lowers and there is no arm under hammer 52, because there is no mold 58 in the ceramic knock-off apparatus 10 or an incorrect number of arms was selected on selector switch 33, hammer carriage assembly 42 lowers farther than it would normally to come in contact with an arm of the mold. When this occurs, the automatic cycle is immediately shut down; hammer carriage assembly 42 rises; amber "AUTO CYCLE ON" pilot light 61 goes out and red flashing "HAMMER OVEREXTENDED" pilot light 65 is lit. To reset ceramic knock-off apparatus 10, the operator switches "OPERATING MODE" selector switch 45 to "MAN" and rotates turntable 26 using black "MANUAL ROTATE" pushbutton 67 until turntable 26 stops and green "CYCLE READY" pilot light 57 is lit indicating that the starting position has been reached. He may then release the pushbutton, make the necessary adjustments, and re-start the cycle.

The automatic cycle may be stopped at any point by depressing red "AUTO CYCLE STOP" pushbutton 43, by stopping scrap removal conveyor 55 by depressing red "SCRAP CONVEYOR STOP" pushbutton 39, by opening the sound enclosure door, or by switching to "MAN". Re-starting the cycle is done as described above.

For manual operation, "OPERATING MODE" selector switch 45 is set to "MAN". Turntable 26 is rotated by depressing black "MANUAL ROTATE" pushbutton 67. The operator may have to release and again depress the pushbutton to start the rotation. Turntable 26 stops at each assumed arm position as the operator holds the pushbutton depressed. The location of the assumed arm position is again dependent upon the number of arms selected on selector switch 33. To rotate turntable 26 farther, the operator releases the pushbutton and then depresses it again. If the sound enclosure door (not shown) is closed and scrap conveyor 55 is running, green "CYCLE READY" pilot light 57 will light when turntable 26 stops at the starting position. Turntable 26 will rotate only if hammer carriage assembly 42 is fully raised.

During manual operation, to lower hammer carriage 42 and hammer 52, the operator depresses black "MANUAL HAMMER" pushbutton 63. Following a shorttime period after carriage 42 has lowered, hammer 52 is activated unless the sound enclosure door (not shown) is not closed, scrap conveyor 55 is not running, or hammer 52 overextends. Hammer 52, if operating, will do so until pushbutton 63 is released.

It should be apparent that various changes, alterations, and modifications may be made to the present invention without departing from the spirit and scope of the present invention as defined in the appended claims. Thus, although this specification describes in detail an operating cycle for the apparatus for removing ceramic from investment casting molds that utilizes conventional relay controls, operation of the invention could also be accomplished by a manual control system, a programmable control system, a computer control system, a control system utilizing solid state switching devices instead of conventional control relays, an air logic control system, or some combination of these or other types of control systems without departing from the spirit and scope of the present invention.

We claim:

1. An apparatus for removing ceramic coatings from investment casting molds, comprising:

rotatable turntable means having a receptacle for receiving and holding the investment casting mold;

carriage means slidably mounted for movement to an engageable position over the top of the investment casting mold;

clamp means mounted on said carriage means and positioned to engage the top of the investment casting mold, said clamp means actuatable to clamp the investment casting mold to the turntable means;

hammer means mounted on said carriage means arranged to operate on the investment casting mold when the turntable means rotates to align the respective arms of the investment casting mold with said hammer means;

power means for supplying operative power to raise and lower said carriage means, to cause said hammer means to break off the ceramic coating from the respective arms of the investment casting mold, to cause the clamp means to clamp the investment casting mold to the turntable means, and to cause said turntable means to rotate; and control means for causing said power means to supply power to raise and lower said carriage means, clamp said clamp means, and rotate said turntable means so that said hammer means is aligned and engaged with the investment casting mold and operated to break off the ceramic coating therefrom.

2. An apparatus for removing ceramic coatings from investment casting molds having a variable number of arms comprising:

rotatable turntable means having a receptacle for receiving and holding the investment casting mold;

carriage means slidably mounted for movement to an engageable position over the top of the investment casting mold;

clamp means mounted on said carriage means and positioned to engage the top of the investment casting mold, said clamp means actuatable to clamp the investment casting mold to the turntable means;

hammer means mounted on the carriage means and arranged to operate on respective arms of the investment casting mold when the turntable means rotates to align the respective arms with said hammer means;

power means for supplying operative power to the carriage means to raise and lower said carriage means, to said hammer means to cause said hammer means to break off the ceramic coating from the respective arms of the mold, to the clamp means to clamp the investment casting mold to the turntable means, and to the turntable means to cause said turntable means to rotate; and control means for automatically causing said power means to supply power in a predetermined, sequential manner to raise and lower said carriage means, clamp said clamp means, and rotate said turntable means so that said hammer means is sequentially aligned and engaged with the arms of the investment casting mold and operated to break off the ceramic coating from the investment casting mold.

3. An apparatus, as claimed in claim 2, wherein said control means includes:

selection means for selecting a variable number of arms for the investment casting mold so that said hammer means can be caused to automatically align with the arms of a mold having any selectable number of arms.

4. An apparatus, as claimed in claim 2, further comprising:

conveyor means for removing broken ceramic removed from the investment casting mold by said hammer means.

5. An apparatus, as claimed in claim 2, wherein said power means is a pneumatic power system.

6. An apparatus, as claimed in claim 5, wherein said hammer means is a pneumatic hammer.

7. An apparatus, as claimed in claim 5, wherein said carriage means includes air bellows means which can be alternatively inflated and deflated by the pneumatic power system to raise and lower the carriage means.

8. An apparatus, as claimed in claim 5, wherein the clamp means includes air bellows means that can be inflated by said pneumatic power system to clamp the investment casting mold.

9. An apparatus for removing the coating from investment casting holds having arms, said apparatus comprising:

hammer means for striking the coating on investment casting molds so as to crack the coating and allow the coating material to drop off;

motor means for positioning said hammer means;

motor means for driving said hammer means;

turntable means having a receptacle for holding the investment casting mold, said turntable means being rotatable for positioning the investment casting mold so that said hammer means is aligned with an arm of the investment casting mold;

motor means for rotating said turntable means;

conveyor means for transferring away from said apparatus the coating material that is removed from the investment casting mold;

motor means for driving said conveyor means;

selection means for selecting the number of arms on the investment casting mold from which the coating is to be removed and for providing an output representative of the number of selected arms;

rotation sensing means for sensing the amount of angular rotation of the turntable means and for providing orientation signals corresponding to the amount of angular rotation of said turntable means;

turntable switching means for receiving the orientation signals from said rotation sensing means and the output of said selection means, said turntable switching means providing output signals that control said motor means for rotating said turntable means so that said motor means rotates said turntable means to sequentially align each of the arms of the investment casting mold into position for striking by said hammer means;

hammer position switching means for providing output signals that control said motor means for positioning said hammer means;

hammer switching means for providing output signals that control said motor means for driving said hammer means for a preselected duration when an arm of the investment casting mold is in position for striking; and homing means for causing repetitive sequential operation of said turntable switching means, said hammer position switching means, and said hammer switching means until the coating has been removed from each of the preselected number of arms of the investment casting mold.

10. An apparatus, as claimed in claim 9, wherein said hammer means comprises a pneumatic hammer.

11. An apparatus, as claimed in claim 9, wherein said motor means for positioning said hammer means comprises:

a hammer carriage having a first and second air bellows respectively positioned on opposite sides of said carriage; and pneumatic means for alternatively inflating and deflating said first air bellows and said second air bellows to raise and lower said hammer means.

12. An apparatus, as claimed in claim 9, wherein said selection means comprises:

a switch having a multiplicity of pairs of switch contacts, said switch having one contact of each pair of contacts connected to a common terminal, said switch also having a multiplicity of selectable settings, each of which causes a corresponding pair from the multiplicity of pairs of switch contacts to be closed; and wherein each of the multiplicity of selectable settings of said switch corresponds to a particular number of equiangular arms on an investment casting mold.

13. An apparatus, as claimed in claim 9, wherein said turntable switching means comprises;

a programmable limit switch for providing output signals that correspond to the angular rotation of said turntable means;

relay switching means which are controlled by said programmable limit switch, said relay switching means having pairs of contacts that are in the open or closed condition depending upon the output signals provided by said programmable limit switch; and solenoid means which are actuated and de-actuated depending upon the condition of said relay switching means, said solenoid means thereby controlling said motor means for rotating said turntable means.

14. An apparatus, as claimed in claim 13, further comprising:

brake means for preventing rotation of said turntable means except when said turntable means is being rotated by said motor means for rotating said turntable means, said brake means being controlled by said turntable switching means.

15. An apparatus, as claimed in claim 9, wherein said hammer position switching means comprises:

a programmable limit switch for providing output signals that correspond to the angular rotation of said turntable means;

relay switching means which are controlled by said programmable limit switch, said relay switching means having pairs of contacts that are in the open or closed condition depending upon the output signals provided by said programmable limit switch; and solenoid means which are actuated and de-actuated depending upon the condition of said relay switching means, said solenoid means thereby controlling said motor means for positioning said hammer means.

16. An apparatus, as claimed in claim 9, wherein said hammer switching means comprises:

a programmable limit switch for providing output signals that correspond to the angular rotation of said turntable means;

relay switching means which are controlled by said programmable limit switch, said relay switching means having pairs of contacts that are in the open or closed condition depending upon the output signals provided by said programmable limit switch;

timer switch means for controlling the duration of each hammer cycle, said timer switch means having a pair of normally open contacts that are closed during each hammer cycle; and solenoid means which are actuated and de-actuated depending upon the condition of said relay switching means and upon the condition of said timer switch means, actuation of said solenoid means by said relay switching means being prevented by said timer switch means except during a hammer cycle when the pair of normally open contacts of said timer switch means are closed, said solenoid means thereby control ling said motor means for driving said hammer means.

17. An apparatus, as claimed in claim 9, further comprising clamp means for holding the investment casting mold firmly in position while said hammer means operates, wherein said clamp means comprises:

air bellows means;

an upper casting receptable mounted to said air bellows means for engaging the investment casting mold;

pneumatic means for inflating said air bellows means thereby causing said upper casting receptacle to exert force against the investment casting mold as the investment casting mold rests on the receptacle of said turntable means, thus holding the investment casting mold in a rigid position; and clamp switch means for controlling said pneumatic means.

18. An apparatus, as claimed in claim 9, further comprising sound enclosure means for confining the noise caused by operation of said hammer means.

19. An apparatus, as claimed in claim 18, further comprising:

hatch means for providing access to within said sound enclosure means for the placement and removal of investment casting molds.

20. An apparatus, as claimed in claim 19, wherein said hatch means comprises:

a hatch;

pneumatic means for causing said hatch to open and close;

solenoid means for controlling said pneumatic means; and means for causing said solenoid means to operate to close said hatch whenever said apparatus is to be operated and to open said hatch whenever said apparatus is not being operated or when operating power is cut off.

21. An apparatus, as claimed in claim 9, wherein said motor means for rotating said turntable means comprises pneumatic motor means.

22. An apparatus, as claimed in claim 9, wherein said motor means for positioning said hammer means comprises pneumatic motor means.

23. An apparatus, as claimed in claim 9, wherein said motor means for driving said hammer means comprises pneumatic motor means.

24. An apparatus for impacting a workpiece, comprising:

rotatable turntable means having a receptacle for receiving and holding the workpiece;

carriage means slidably mounted for movement to an engageable position proximate the workpiece;

clamp means mounted on said carriage means and positioned to clamp the workpiece on said turntable means when said carriage means is moved to an engageable position proximate the workpiece and said clamp means is actuated;

hammer means mounted on said carriage means and arranged to impact the workpiece when said turntable means rotates to align the workpiece with said hammer means and said carriage means is moved to an engageable position proximate the workpiece;

power means for supplying operative power to move said carriage means, to cause said clamp means to clamp the workpiece on said turntable means, to cause said hammer means to impact the workpiece, and to cause said turntable means to rotate; and control means for causing said power means to supply power to move said carriage means, to clamp said clamp means, to cause said hammer means to impact the workpiece, and to rotate said turntable means.

* * * * *